US008641395B2

(12) United States Patent
Nemit, Jr.

(10) Patent No.: US 8,641,395 B2
(45) Date of Patent: Feb. 4, 2014

(54) COMPRESSOR

(75) Inventor: Paul Nemit, Jr., Waynesboro, PA (US)

(73) Assignee: Johnson Controls Technology Company, Holland, MI (US)

( * ) Notice: Subject to any disclaimer, the term of this patent is extended or adjusted under 35 U.S.C. 154(b) by 772 days.

(21) Appl. No.: 12/752,959

(22) Filed: Apr. 1, 2010

(65) Prior Publication Data

US 2010/0254845 A1 Oct. 7, 2010

Related U.S. Application Data

(60) Provisional application No. 61/166,290, filed on Apr. 3, 2009.

(51) Int. Cl.
*F04C 18/00* (2006.01)

(52) U.S. Cl.
USPC ..... 418/201.1; 418/2; 418/180; 137/625.28

(58) Field of Classification Search
USPC ..... 418/201.2, 2, 180, 201.1, 270; 137/625.25, 625.28; 417/213, 310
See application file for complete search history.

(56) References Cited

U.S. PATENT DOCUMENTS

| | | | | | |
|---|---|---|---|---|---|
| 3,936,239 | A * | 2/1976 | Shaw | 417/315 |
| 4,877,380 | A * | 10/1989 | Glanvall | 417/310 |
| 5,135,374 | A * | 8/1992 | Yoshimura et al. | 418/201.2 |
| 5,207,568 | A * | 5/1993 | Szymaszek | 418/203 |
| 5,707,223 | A * | 1/1998 | Englund et al. | 418/1 |
| 6,050,797 | A * | 4/2000 | Zhong | 418/203 |
| 6,059,551 | A * | 5/2000 | Amano et al. | 418/84 |
| 6,093,007 | A | 7/2000 | Shaw | |
| 6,186,758 | B1 | 2/2001 | Shaw | |
| 6,506,031 | B2 * | 1/2003 | Sishtla | 417/366 |
| 6,551,084 | B2 * | 4/2003 | Sundstrom | 418/203 |
| 7,347,301 | B2 | 3/2008 | Sekiya et al. | |
| 2008/0260539 | A1 * | 10/2008 | Stinessen et al. | 417/26 |

* cited by examiner

*Primary Examiner* — Thomas Denion
*Assistant Examiner* — Thomas Olszewski
(74) *Attorney, Agent, or Firm* — McNees Wallace & Nurick LLC

(57) ABSTRACT

A system is provided for controlling the balance piston pressure in a screw compressor. The system can use the slide valve of the compressor as a valve to control the flow of fluid from a fluid source to the balance piston. When the slide valve prevents direct flow between the fluid source and the balance piston, an alternate path is used to provide fluid at a reduced pressure to the balance piston. The reduced pressure fluid is obtained by passing the fluid from the fluid source through an orifice to lower the fluid pressure.

20 Claims, 5 Drawing Sheets

COMPRESSOR

CROSS-REFERENCE TO RELATED APPLICATIONS

This application claims priority from and the benefit of U.S. Provisional Application No. 61/166,290, entitled COMPRESSOR, filed Apr. 3, 2009 which is hereby incorporated by reference.

BACKGROUND

The application generally relates to positive-displacement compressors. The application relates more specifically to controlling balance piston pressure in a screw compressor.

In a screw compressor, the gas can be drawn, compressed, and discharged by the rotation of a male rotor and a corresponding female rotor. In many screw compressors, the male rotor can be used to drive the female rotor. The predominant force on the male rotor can be from thrust. A portion of the thrust force comes from the pressure of discharge gas acting on the end plane of the male rotor. However, a sizable portion of the thrust force comes from torque transmission between the rotors. If the thrust force is not balanced or otherwise reduced, the male rotor, the female rotor, bearings and/or other components can rapidly wear through friction.

To counteract the thrust force, many screw compressors may use a thrust bearing in conjunction with a balance piston at the opposite end of the rotor. The balance piston can be used to reduce the size and cost of the thrust bearing required to handle the thrust force at full load operation of the compressor.

The balance piston can be a round disk that is tightly fitted to the male rotor and keyed to the rotor. The outer diameter of the balance piston can be grooved to create a labyrinth seal to permit flow but to reduce viscous losses. The outer diameter of the balance piston and the mating surface in the rotor housing can be controlled to extremely tight tolerances to control fluid flow. By applying fluid pressure behind the balance piston, a counteracting or balancing force in the opposite direction to the thrust force can be generated. The size of the balancing force can be dependent upon the diameter of the balance piston and the pressure of the fluid apply to the balance piston.

In many screw compressors, the balance piston and thrust bearing can offset 75% or more of the thrust forces at full load operation of the compressor. However, when the compressor is unloaded, such as by using a slide valve, the rotor load and thrust force can decrease, while the balance piston force can stay relatively constant. If the balance piston force is not reduced to match the reduction in thrust force, the balance piston force can very easily overpower the thrust bearing and cause the thrust bearing to fail. Therefore, many screw compressors may use a pressure control system to regulate the balance piston pressure. The pressure control system can include control algorithms, a regulator, a solenoid valve, a pressure transducer, and a gauge or feedback mechanism to determine the position of the slide valve. A drawback to the pressure control system is that the equipment is expensive, difficult to set up, and can malfunction.

Therefore, what is needed is a system to automatically regulate the balance piston pressure without complicated control schemes and extensive parts lists.

SUMMARY

The present invention is directed to a compressor including an intake passage, a compression mechanism and a outlet passage in fluid communication. The compression mechanism is configured and positioned to receive a vapor from the intake passage and to provide vapor at a higher pressure to the outlet passage. The compression mechanism includes a member. The member is configured and positioned to counteract axial forces generated in the compression mechanism. The compressor also includes a first valve configured and positioned to adjust compressor capacity. The first valve includes a valve body. The valve body is positionable in a first position relative to the outlet passage to provide a first output capacity for the compressor and the valve body being positionable in a second position relative to the outlet passage to provide a second output capacity for the compressor, the first output capacity being greater than the second output capacity. The compressor further includes a system configured and positioned to apply a fluid pressure to the member to generate an axial force to counteract axial forces generated in the compression mechanism. The system includes a fluid source having a fluid at a first pressure, a first connection between the fluid source and the member to provide fluid at the first pressure to the member, and a second connection between the fluid source and the member to provide fluid at a second pressure to the member, the second pressure being less than the first pressure. The system also includes a second valve positioned in the first connection to control fluid flow in the first connection. The second valve includes the valve body and has a first position to permit fluid flow in the first connection and a second position to prevent fluid flow in the first connection.

The present invention is further directed to a screw compressor including an intake passage to receive vapor and a discharge passage to supply vapor and a pair of intermeshing rotors. The pair of intermeshing rotors is configured to receive vapor from the intake passage and to provide compressed vapor to the discharge passage. The screw compressor also includes a drive shaft with one rotor of the pair of intermeshing rotors mounted on the drive shaft. A piston is mounted on the drive shaft at one end of the rotor and a bearing is mounted on the drive shaft at the opposite end of the rotor. The screw compressor further includes a slide valve positioned near the pair of intermeshing rotors to adjust an amount of compressed vapor received at the discharge passage. The slide valve includes a valve body moveable in a bore. The valve body is positionable in a first position to enable a first amount of compressed vapor to enter the discharge passage and the valve body is positionable in a second position to enable a second amount of compressed vapor to enter the discharge passage, the first amount being greater than the second amount. The screw compressor includes a control system to apply a fluid pressure to the piston to generate an axial force to offset axial forces generated by the rotor. The control system is configured to automatically adjust the fluid pressure applied to the piston in response to movement of the valve body between the first position and the second position.

The present invention is additionally directed to a fluid pressure control system for a balance piston of a screw compressor. The fluid pressure control system includes a fluid source to provide a pressurized fluid at a first pressure and a fluid connection between the fluid source and the balance piston to provide pressurized fluid to the balance piston. The fluid connection includes a first portion having pressurized fluid at the first pressure and a second portion having pressurized fluid at a second pressure less than the first pressure. The control system also includes a valve configured and positioned to automatically adjust the fluid pressure applied to the balance piston by the fluid connection in response to movement of a slide valve in the screw compressor. The valve has a first position to provide pressurized fluid to the balance piston from the first portion and a second position to provide pressurized fluid to the balance piston from the second portion. The first position of the valve corresponds to a loaded position of the slide valve and the second position of the valve corresponds to an unloaded position of the slide valve.

One advantage of the present application is the use of the components of the slide valve to control balance piston pressure.

Another advantage of the present application is the elimination of the solenoid valve, regulator and feedback mechanism to control balance piston pressure.

DETAILED DESCRIPTION OF THE EXEMPLARY EMBODIMENTS

Figure 1:
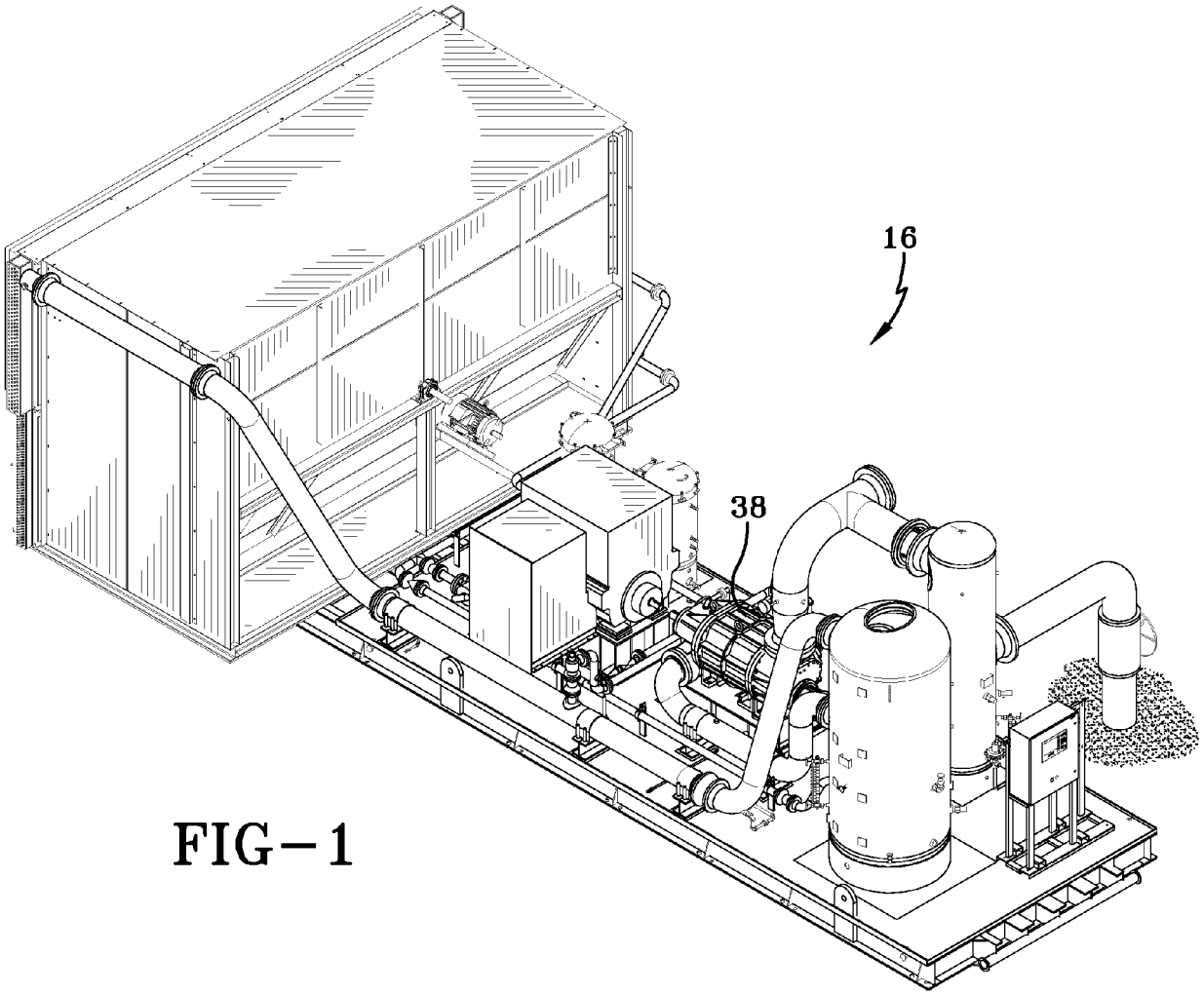
FIG. 1 shows an exemplary embodiment of a compressor in an industrial environment.

Referring to FIG. 1, an exemplary environment for a vapor compression system 16 is shown. In the exemplary environment, vapor compression system 16 is depicted as being used at a point where natural gas is recovered, for example, at a well head. The natural gas recovered and pressurized by vapor compression system 16 can be transported to and through a pipeline. In another exemplary embodiment, vapor compression system 16 can be incorporated into a heating, ventilation, air conditioning and refrigeration (HVAC&R) system.

Figure 2:
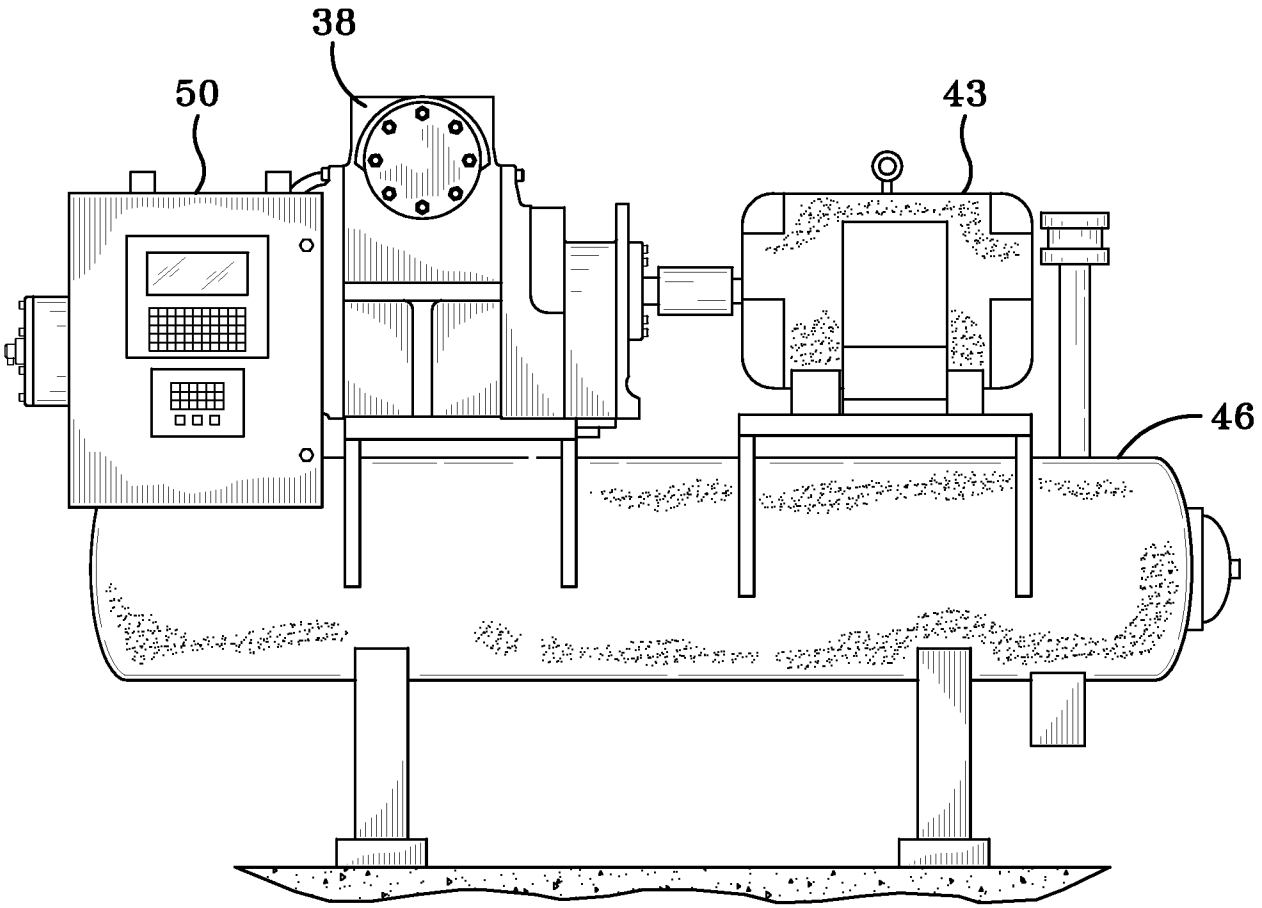
FIG. 2 shows an exemplary embodiment of a compressor in a packaged unit.

Referring to FIG. 2, vapor compression system 16 may include a compressor in a packaged unit. The packaged unit may include a screw compressor 38 and a torque generator or prime mover 43 to drive screw compressor 38. A control panel 50 to provide control instructions to the equipment can be included in the packaged unit. An oil separator 46 can be provided to remove entrained oil (used to lubricate the rotors of screw compressor 38) from the discharge vapor of compressor 38 before providing the discharge vapor to its intended application. In vapor compression system 16, oil separator 46 can be in fluid communication with compressor 38. An oil and gas mixture can flow from compressor 38 to oil separator 46 where the oil is removed from the vapor. The separated oil in oil separator 46 can be returned to compressor 38 via an oil return line. The vapor flows from oil separator 46 to the desired application. Torque generator or prime mover 43 can be a turbine powered by using a small portion of the natural gas from the well head, an electrical motor powered by electrical power, and/or an engine powered by combusting natural gas or other fuel.

Figure 3:
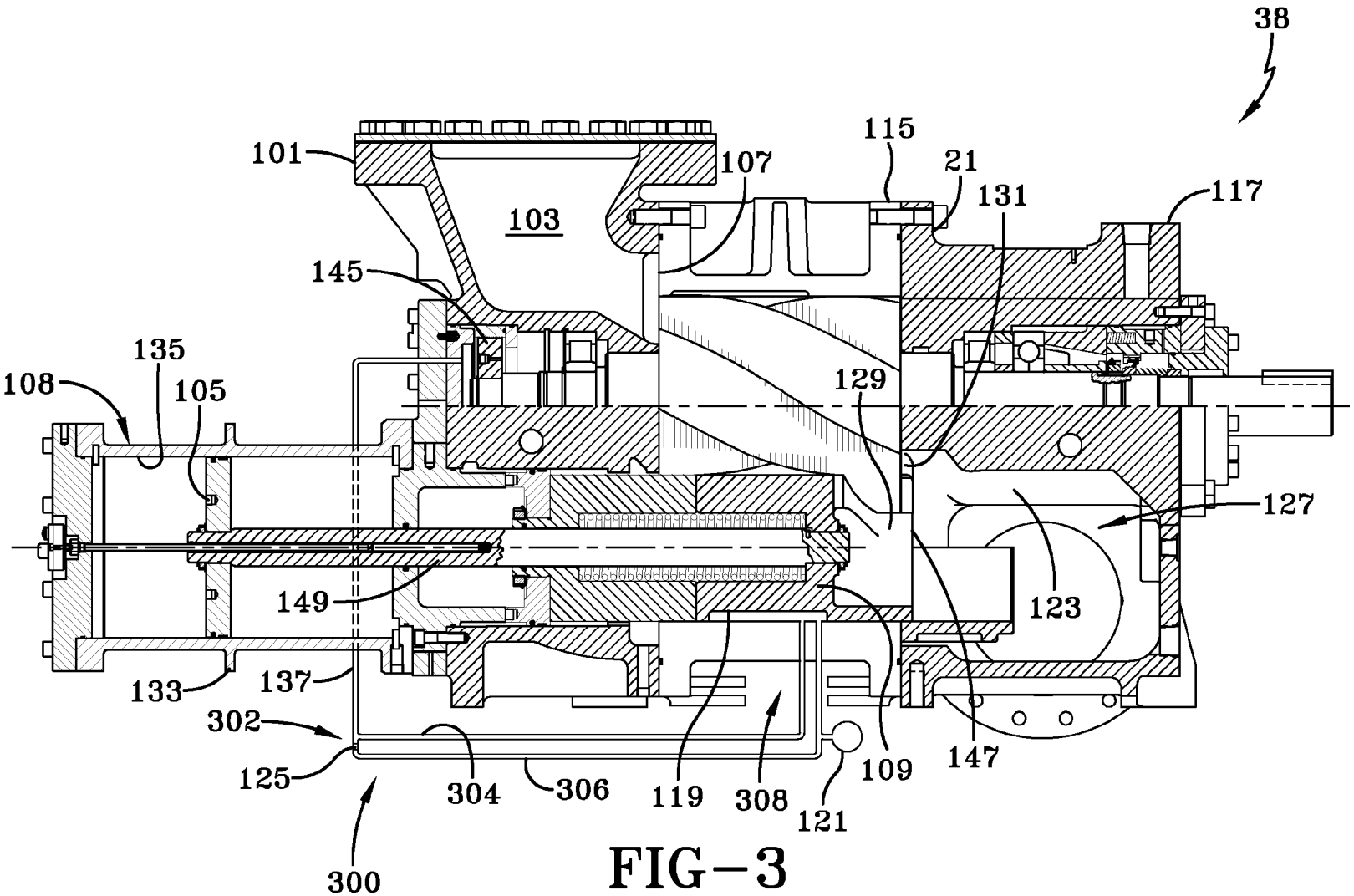
FIG. 3 shows a cross-sectional view of an exemplary embodiment of a screw compressor with a slide valve in the closed position.
Figure 4:
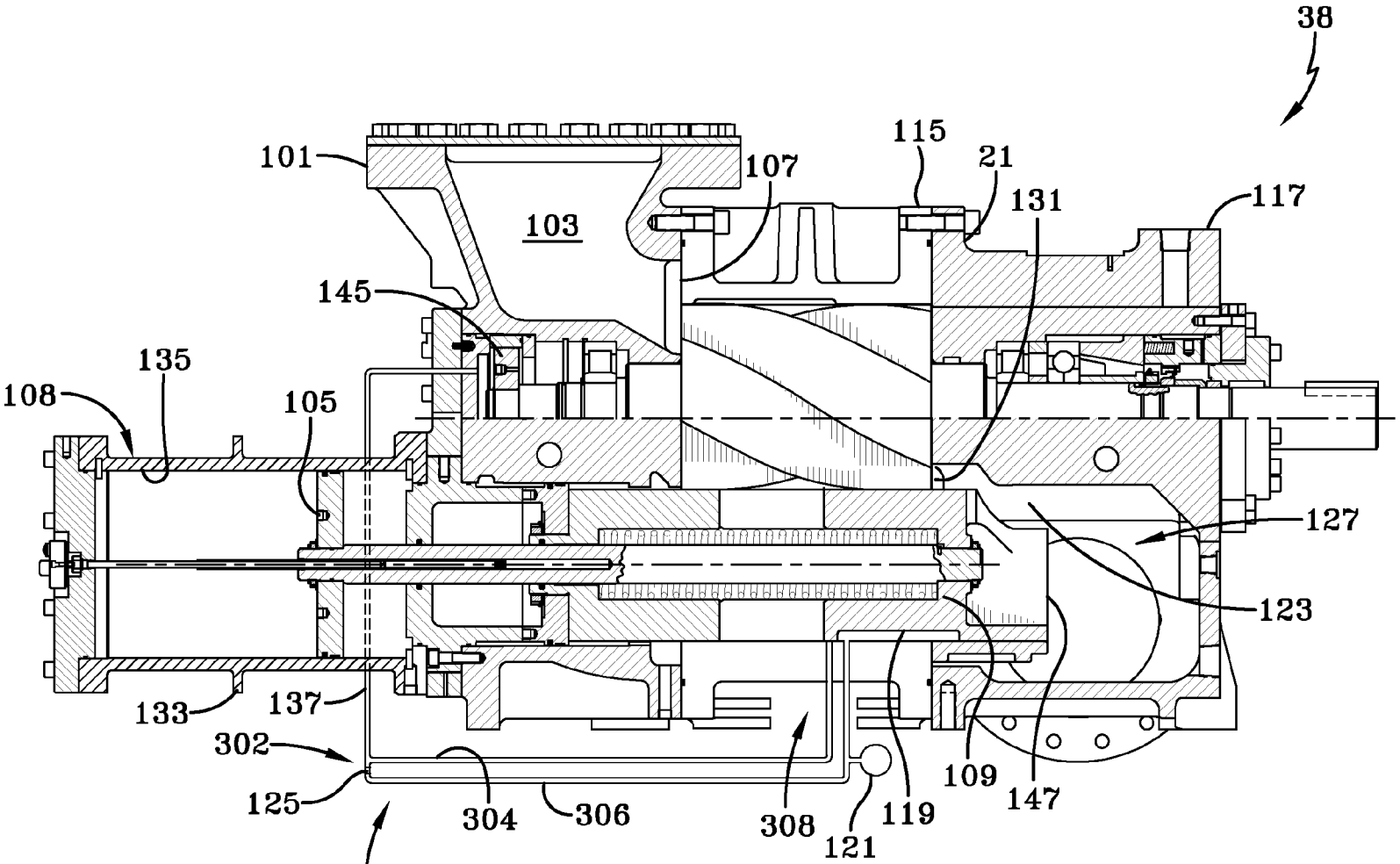
FIG. 4 shows a cross-sectional view of an exemplary embodiment of a screw compressor with a slide valve in the open position.

FIGS. 3 and 4 show an exemplary embodiment of a screw compressor 38. Compressor 38 includes a compressor housing 21 that contains the working parts of compressor 38. Compressor housing 21 includes an intake housing 101, a rotor housing 115, a discharge housing 117, and a slide valve housing 133. Compressor 38 compresses a vapor and delivers the compressed vapor to a desired application through a discharge line (not shown).

Vapor is directed from a source (not shown) to an intake passage 103 of compressor 38. Exemplary sources for providing vapor to intake passage 103 include a pipeline, a container, a processing facility, a heat exchanger, and a well head. Torque generator or prime mover 43 (see FIG. 2) may be connected to rotors of compressor 38 by a drive shaft.

Vapor flows from intake passage 103 and enters rotor housing 115 at a suction port 107. The vapor then enters compression pockets defined between the surfaces of a male rotor and a female rotor of compressor 38. The rotors of compressor 38 can matingly engage with each other via intermeshing lands and grooves. Each of the rotors of compressor 38 can revolve in an accurately machined cylinder within rotor housing 115. As the rotors of compressor 38 engage one another, compression pockets between the rotors of compressor 38, also referred to as lobes, are reduced in size and are axially displaced to a discharge side of compressor 38. The compressed vapor is discharged into discharge housing 117. The compressed vapor eventually exits compressor 38 for its intended application.

Compressor 38 can include a slide valve 108 to control the capacity of compressor 38. Slide valve 108 includes valve body 109 and a piston 105 rigidly connected to one another by a shaft 149. Valve body 109 forms a portion of the boundary of rotor housing 115, and provides the ability to adjust the amount of the rotor threads exposed to a discharge port 127 of compressor 38. Compressed vapor exits the rotors of compressor 38 into discharge passage 123 at discharge port 127. Discharge port 127 has two portions, the first being a radial portion 129 formed by a discharge end 147 of valve body 109 and the second being an axial portion 131 formed by discharge housing 117. The geometry of rotor housing 115 provides for the size of radial portion 129 to be controlled by the position of discharge end 147 of valve body 109.

Slide valve 108 can be adjusted to control the position of valve body 109 relative to the rotors of compressor 38 by fluid pressure applied to piston 105. Piston 105 is contained in a cylinder 135 of housing 133 and is configured to divide cylinder 135 into two distinct chambers, one chamber on either side of piston 105.

To unload compressor 38, piston 105 is moved in cylinder 135 to move valve body 109 toward discharge passage 123. The movement of valve body 109 toward discharge passage 123 results in valve body 109 being in an unloaded position and reveals a recirculation port for vapor to return to intake passage 103 as shown in FIG. 4. To load compressor 38, piston 105 is moved in cylinder 135 to move valve body 109 away from discharge passage 123. The movement of valve body 109 away from discharge passage 123 results in valve body 109 being in a loaded position and closes the recirculation port as shown in FIG. 3. To partially load or unload compressor 38, fluid pressure can move piston 105 and valve body 109 to partially open or close the recirculation port. In an exemplary embodiment, the position of piston 105 can be maintained by balancing the fluid pressures in the chambers on opposite sides of piston 105 after piston 105 is in a desired position. Piston 105 is designed to slide freely in cylinder 135 without permitting fluid to flow around piston 105. A seal can be provided to prevent fluid leakage around piston 105.

Figure 5:
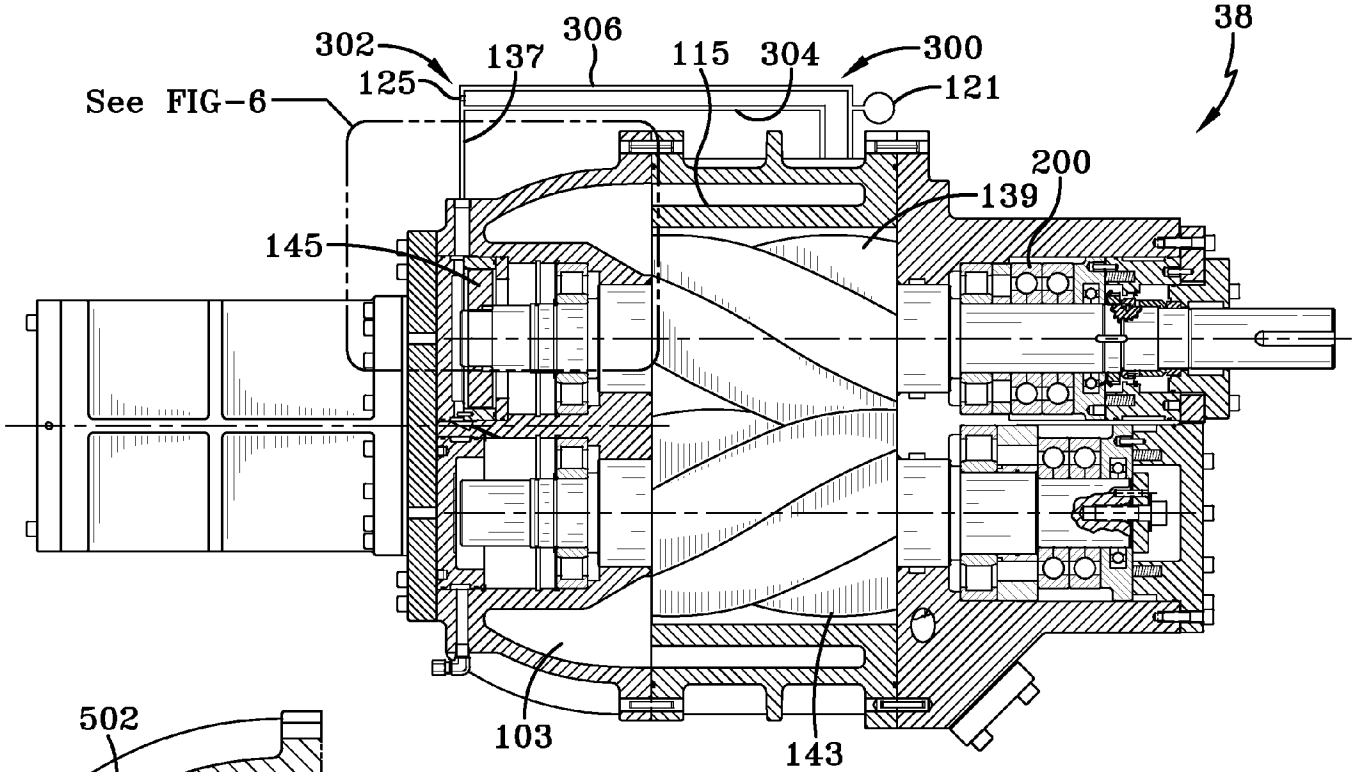
FIG. 5 shows a top view of an exemplary embodiment of a screw compressor.
Figure 6:
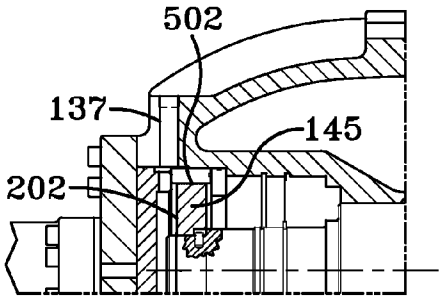
FIG. 6 shows an enlarged view of a portion of the screw compressor of FIG. 5.

FIG. 5 shows a male rotor 139 and a female rotor 143 (or compression mechanism) in compressor 38. To control the thrust forces on male rotor 139, a thrust bearing 200 can be used with a balance piston or member 145. Balance piston 145 can be used for balancing the thrust by providing force in the opposite direction, i.e., a force in the direction of thrust bearing 200. As shown in FIG. 6, balance piston 145 may be a disc fitted and/or keyed to male rotor 139. Balance piston 145 can have grooves formed along at least a portion of the peripheral surface of balance piston 145 forming a labyrinth seal 502 to permit flow and/or reduce viscous losses. In one exemplary embodiment, the diameter of balance piston 145 can be selected to provide a desired amount of force when used in conjunction with the application of a fluid at a preselected pressure onto surface 202 of balance piston 145.

FIGS. 3-5 show an exemplary embodiment of a system 300 for controlling the fluid pressure applied to balance piston 145. System 300 can include a fluid source 121 to provide a pressurized fluid to balance piston 145. The pressurized fluid can be oil, gas, such as an industrial processing gas, a refrigerant, or any other suitable fluid. System 300 also includes a fluid line or connection 137 in fluid communication with fluid source 121 to provide pressurized fluid to balance piston 145. Fluid line 137 includes a junction point 302 where a first line or connection 304 from fluid source 121 is connected to a second line or connection 306 from fluid source 121. First line 304 includes a valve 308 to control the flow of fluid between fluid source 121 and junction point 302. Second line 306 includes an orifice or flow restrictor 125 between fluid source 121 and junction point 302. In an exemplary embodiment, a flow regulator can be included instead of, or in addition to, orifice 125.

Valve 308 can be used to open or close first line 304 to either provide fluid pressure to balance piston 145 at the pressure of fluid in fluid source 121 (open position) or to force fluid from fluid source 121 into second line 306 and orifice 125 to provide fluid to balance piston 145 at a reduced pressure from fluid source 121 (closed position). The passage of the fluid through orifice 125 operates to lower the pressure of the fluid from fluid source 121. In an exemplary embodiment, valve 308 can be incorporated into valve body 109 of slide valve 108. Valve body 109 can include a slot or recess 119 that can either permit or prevent fluid flow in line 304, depending on the position of valve body 109. FIG. 3 shows valve 308 in the open position to permit fluid flow from fluid source 121 through line 304 to junction point 302 and balance piston 145. In contrast, FIG. 4 shows valve 308 in the closed position to prevent fluid flow from fluid source 121 through line 304 to junction point 302 and balance piston 145.

In an exemplary embodiment, slot 119 can be milled or formed into valve body 109. Two ports are positioned a preselected distance apart in the bore in which valve body 109 moves. In an exemplary embodiment, slot 119 can be positioned in the bottom of valve body 109 and the ports can be positioned in the bottom of the corresponding bore. Fluid can be supplied to one of the ports by fluid source 121 and the other port can provide a fluid connection to junction point 302 and balance piston 145 when valve 308 is open. When valve body 109 is in the loaded position, valve 308 is in the open position and the ports are connected together by slot 119 to permit fluid at the pressure of the fluid source to travel to balance piston 145. However, when valve body 109 is in the unloaded position, valve 308 is in the closed position and slot 119 is moved away from the ports to thereby close or seal one or both of the ports with valve body 109. In an exemplary embodiment, the size of slot 119 is configured to permit fluid flow between the ports when valve body 109 is in the loaded position and to prevent fluid flow between the ports when valve body 109 is in the unloaded position. When valve 308 is in the closed position (corresponding to an unloaded position of valve body 109), balance piston 145 only receives fluid traveling through orifice 125, which drops the fluid pressure (and corresponding force) behind balance piston 145 to thereby reduce the force applied by balance piston 145 to a level corresponding to the thrust forces on the unloaded compressor.

The configuration of system 300 to permit the application of at least two different fluid pressures on balance piston 145 based upon the position of valve body 109 may permit balance piston 145 to automatically provide appropriate balancing forces to the axial thrust force on male rotor 139. In exemplary embodiments, more than two different pressures may be selectively applied to balance piston 145. For example, more than two lines may meet at junction point 302. One line can provide fluid at the pressure of the fluid source and the other lines can include different orifices or flow restrictors to provide different pressures to balance piston 145. In another exemplary embodiment, multiple slots can be formed in valve body 109 with corresponding ports to permit different lines to be connected to junction point 302, depending on the position of valve body 109.

While only certain features and embodiments of the invention have been shown and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, colors, orientations, etc.) without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the invention. Furthermore, in an effort to provide a concise description of the exemplary embodiments, all features of an actual implementation may not have been described (i.e., those unrelated to the presently contemplated best mode of carrying out the invention, or those unrelated to enabling the claimed invention). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

What is claimed is:

1. A compressor comprising:

an intake passage, a compression mechanism and an outlet passage in fluid communication;

the compression mechanism being configured and positioned to receive a vapor from the intake passage and to provide vapor at a higher pressure to the outlet passage, the compression mechanism comprising a member, the member being configured and positioned to counteract axial forces generated in the compression mechanism;

a first valve configured and positioned to adjust compressor capacity, the first valve comprising a valve body forming a portion of a housing for the compression mechanism, the valve body being positionable in a first position relative to the outlet passage to provide a first output capacity for the compressor and the valve body being positionable in a second position relative to the outlet passage to provide a second output capacity for the compressor, the first output capacity being greater than the second output capacity;

a fluid source storing a fluid at a first pressure, the fluid source being separate from both the intake passage and the outlet passage;

a first connection between the fluid source and the member to provide fluid from the fluid source at the first pressure to the member;

a second connection between the fluid source and the member to provide fluid from the fluid source at a second pressure to the member, the second pressure being less than the first pressure;

a second valve positioned in the first connection to control fluid flow in the first connection, the second valve comprising the valve body and a slot in the valve body, the second valve having a first position to permit fluid flow in the slot and the first connection and a second position to prevent fluid flow in the slot and the first connection; and a fluid pressure from the fluid source being applied to the member to generate an axial force to counteract axial forces generated in the compression mechanism.

2. The compressor of claim 1 wherein the second valve is in the first position in response to the valve body being in the first position and the second valve is in the second position in response to the valve body being in the second position.

3. The compressor of claim 2 wherein:

the first valve comprises a bore;

the bore comprises a first port and a second port separated by a preselected distance;

the valve body is configured and positioned to move axially in the bore;

the second valve comprises the first port and the second port;

the first port is in fluid communication with the fluid source and the second port is in fluid communication with the member; and the first port is connected to the second port by the slot when the second valve is in the first position.

4. The compressor of claim 3 wherein the first port is disconnected from the second port by the valve body when the second valve is in the second position.

5. The compressor of claim 4 wherein the second connection comprises a flow restriction to lower fluid pressure in the second connection.

6. The compressor of claim 5 wherein the flow restriction comprises an orifice.

7. The compressor of claim 5 wherein the first connection and the second connection are joined to form a single line, the flow restriction being positioned upstream of the single line and the second valve being positioned upstream of the single line.

8. The compressor of claim 1 wherein application of fluid to the member at the first pressure generates a first axial force and application of fluid to the member at the second pressure generates a second axial force less than the first axial force.

9. A screw compressor comprising:

an intake passage to receive vapor and a discharge passage to supply vapor;

a pair of intermeshing rotors, the pair of intermeshing rotors being configured to receive vapor from the intake passage and provide compressed vapor to the discharge passage;

a drive shaft, one rotor of the pair of intermeshing rotors being mounted on the drive shaft;

a piston being mounted on the drive shaft at one end of the rotor and a bearing being mounted on the drive shaft at the opposite end of the rotor;

a slide valve positioned near the pair of intermeshing rotors to adjust an amount of compressed vapor received at the discharge passage, the slide valve comprising a valve body moveable in a bore, the valve body forming a portion of a housing for the pair of intermeshing rotors, the valve body being positionable in a first position to enable a first amount of compressed vapor to enter the discharge passage and the valve body being positionable in a second position to enable a second amount of compressed vapor to enter the discharge passage, the first amount being greater than the second amount;

a fluid pressure from a fluid source being applied to the piston to generate an axial force to offset axial forces generated by the rotor, the fluid source being independent from the intake passage and the discharge passage and having fluid at a first pressure; and the valve body of the slide valve moving between the first position and the second position automatically adjusts the fluid pressure applied to the piston, the first position of the valve body providing access to a slot in the valve body resulting in fluid at the first pressure being applied to the piston and the second position of the valve body preventing access to the slot in the valve body resulting in fluid at a second pressure lower than the first pressure being applied to the piston.

10. The screw compressor of claim 9 further comprises:

a fluid connection between the fluid source and the piston to provide fluid to the piston;

the fluid connection comprising a first portion in fluid communication with the fluid source to provide fluid at the first pressure and a second portion in fluid communication with the fluid source to provide fluid at the second pressure; and a valve positioned in the first portion to control fluid flow in the first portion, the valve comprising the valve body and the slot, the valve having an open position to permit fluid flow in the first portion and a closed position to prevent fluid flow in the first portion.

11. The screw compressor of claim 10 wherein the valve is in the open position in response to the valve body being in the first position and the valve is in the closed position in response to the valve body being in the second position.

12. The screw compressor of claim 11 wherein:

the bore comprises a first port and a second port separated by a preselected distance;

the valve comprises the first port and the second port; and the first port is connected to the second port by the slot when the valve is in the first position and the first port is disconnected from the second port by the valve body when the valve is in the second position.

13. The screw compressor of claim 12 wherein the second portion comprises a pressure reduction device to lower fluid pressure in the second connection.

14. The screw compressor of claim 13 wherein the pressure reduction device comprises an orifice.

15. The screw compressor of claim 13 wherein the first portion and the second portion are connected at a junction, the pressure reduction device being positioned upstream of the junction and the valve being positioned upstream of the junction.

16. The screw compressor of claim 10 wherein only the second portion of the fluid connection provides fluid to the piston when the valve is in the closed position.

17. The screw compressor of claim 10 wherein application of fluid to the piston at the first pressure generates a first axial force and application of fluid to the piston at the second pressure generates a second axial force less than the first axial force.

18. A fluid pressure control system for a balance piston of a screw compressor, the fluid pressure control system comprising:

a fluid source, the fluid source storing a pressurized fluid at a first pressure, the fluid source being separate from an intake passage and a discharge passage of the screw compressor;

a fluid connection between the fluid source and the balance piston to provide pressurized fluid to the balance piston;

the fluid connection comprising a first portion providing pressurized fluid from the fluid source to the balance piston at the first pressure and a second portion providing pressurized fluid from the fluid source to the balance piston at a second pressure less than the first pressure;

a valve configured and positioned to automatically adjust the fluid pressure applied to the balance piston by the fluid connection in response to movement of a slide valve in the screw compressor, the valve comprising a valve body of the slide valve and a slot in the valve body;

the valve having a first position to provide pressurized fluid at the first pressure to the balance piston from the slot and the first portion and a second position to provide pressurized fluid at the second pressure to the balance piston from the second portion; and the first position of the valve corresponding to a loaded position of the slide valve and the second position of the valve corresponding to an unloaded position of the slide valve.

19. The fluid pressure control system of claim 18 wherein the valve comprises:

a bore configured to permit movement of the valve body;

a plurality of ports in the bore, one port of the plurality of ports being in fluid communication with the fluid source and another port of the plurality of ports being in fluid communication with the balance piston; and the plurality of ports are fluidly connected by the slot when the valve is in the first position and the plurality of ports are prevented from fluid communication by the valve body when the valve is in the second position.

20. The fluid pressure control system of claim 19 wherein the second portion of the fluid connection comprises an orifice to generate the pressurized fluid at the second pressure.

* * * * *